US005154653A

United States Patent [19]

Ketterman et al.

[11] Patent Number: 5,154,653

[45] Date of Patent: Oct. 13, 1992

[54] BUNG PLUG ASSEMBLY

[75] Inventors: Kenneth L. Ketterman, Hampton; Raymond M. Kinne, Newport News, both of Va.

[73] Assignee: Hampton Rubber Company, Hampton, Va.

[21] Appl. No.: 661,006

[22] Filed: Feb. 26, 1991

[51] Int. Cl.[5] ..... B63C 9/22

[52] U.S. Cl. ..... 440/84; 440/42

[58] Field of Search ..... 441/35, 40–42, 441/80–85

[56] References Cited

U.S. PATENT DOCUMENTS

| | | | |
|---|---|---|---|
| 2,959,278 | 11/1960 | Mitchell et al. | 206/46 |
| 2,968,820 | 1/1961 | Pritty | 9/11 |
| 3,448,471 | 6/1969 | Oldham | 9/11 |
| 3,507,417 | 4/1970 | McCarthy et al. | 220/5 |
| 4,280,239 | 7/1981 | Brown | 9/11 |

FOREIGN PATENT DOCUMENTS

| | | | |
|---|---|---|---|
| 677203 | 12/1963 | Canada | 441/42 |
| 1007054 | 10/1965 | United Kingdom | 441/42 |
| 1121658 | 7/1968 | United Kingdom | 441/84 |

*Primary Examiner*—Edwin L. Swinehart

*Attorney, Agent, or Firm*—Griffin Branigan & Butler

[57] ABSTRACT

A bung plug assembly (30) for a clamshell life-raft canister (14) comprises a tubularly-shaped housing (32) for holding wound, or coiled, rope (84) with a resilient grommet cap (34) on an outwardly-directed end (64) thereof and a resilient rear cap (36) on an inwardly-directed end (66) thereof. The resilient grommet cap defines a grommet-cap bore (40) therethrough through which an outer-end portion (50) of the rope extends and a canister slot (72) for receiving edges of top and bottom halves (16, 18) of the canister as well as a key slot (46) for receiving a resilient molded key (44) to engage an edge of at least one canister half. A bung plug (38) having a rope passage (42) therethrough for receiving the outer-end portion of the rope is inserted into the grommet-cap bore. The tubularly-shaped housing has a smooth inner surface (56) but has annular slots (60, 62) in an outer surface (58) at outwardly- and inwardly-directed ends for receiving radially inwardly directed flanges (68, 71) of the grommet cap and the rear cap. The outer-end portion of the rope pays out from an interior of a rope winding (48).

23 Claims, 4 Drawing Sheets

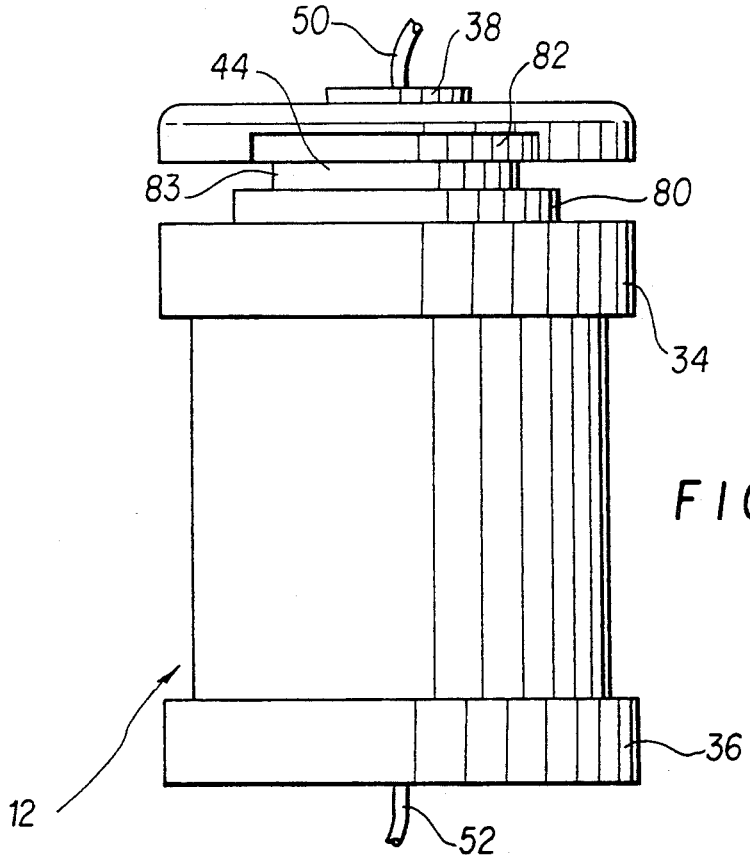
FIG. 4
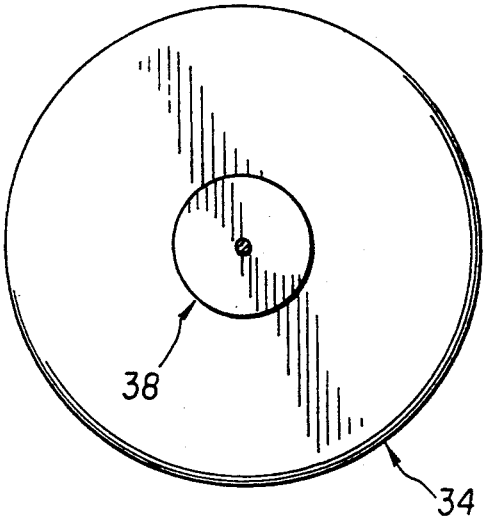
FIG. 5
FIG. 6
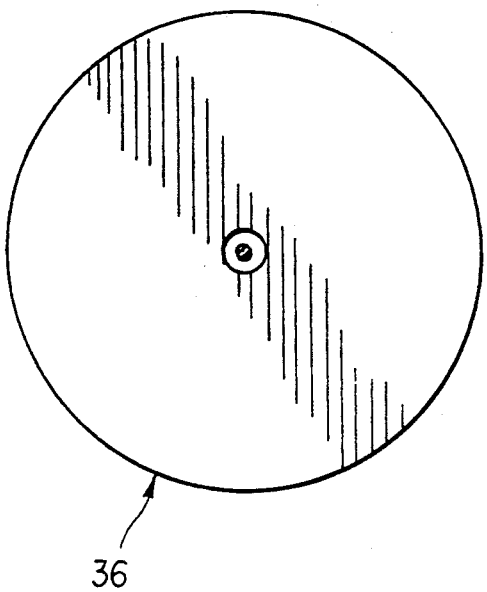

BUNG PLUG ASSEMBLY

BACKGROUND OF THE INVENTION

This application relates broadly to devices for holding coiled rope in life raft canisters for allowing easy pay out thereof in times of emergency.

Some life raft storage systems comprise clamshell canisters designed to hold, for example, sixteen man life rafts with provisions for survival at sea in an event of an emergency. Such life rafts are inflated by means of compressed-air cylinders which are also encased in the clamshell canisters. Compressed air is released from the cylinders into the rafts when lanyards, that are respectively attached to valves of the cylinders, are pulled. In a prior-art example, such a lanyard is attached to an inner-end portion of a 100 foot coiled rope or rope bundle, which is also encased in the clamshell canister, with an outer-end portion of the coiled rope being attached to a tie cleat on a boat. When an emergency occurs, for example when a boat on which such a clamshell canister is mounted is sinking, the clamshell canister is thrown overboard along with the enclosed life raft and compressed-air cylinder. Since the outer-end portion of the coiled rope is affixed to the boat, as the clamshell canister and life raft fall downwardly the coiled rope is paid out, or pulled out, of the clamshell canister until the clamshell canister travels 100 feet from a tie cleat to which its outer-end portion is attached. At this point, the rope is placed under tension, which tension pulls the lanyard, thereby opening a valve on the cylinder of compressed air to inflate the raft in the clamshell canister. As the raft inflates, it applies outwardly directed force on the clamshell canister, which separates top and bottom halves of the clamshell canister, thereby releasing the life raft to be ready for use.

Previous methods of storing coiled rope in such clamshell canisters has often caused "snagging" of the rope during pay out thereof. That is, while a coiled rope is being paid out of a falling clamshell canister, it has sometimes, snagged, so that it never applied tension on an inner-end portion of the rope and therefore never activated a cylinder of compressed air. It is therefore an object of this invention to provide a bung plug assembly which allows easy pay out of a rope from a clamshell canister with reduced possibilities of snagging.

A similar and related problem for some prior-art clamshell canister assemblies is that it has been time consuming and difficult to prepare and install coiled ropes therefor. Thus, it is an object of this invention to provide a bung plug assembly which not only decreases snagging during rope pay out but also which can be easily and quickly installed.

Similarly, it is an object of this invention to provide a bung plug assembly which can be relatively easily inspected and refurbished.

It is also an object of this invention to provide a bung plug assembly which reduces premature rope pay out.

In some prior art clamshell canister assemblies, bung plug assemblies and coiled-rope organizers were not attached to one another, which sometimes allowed undesirable independent action therebetween during rope pay out and sometimes required extra steps during assembly thereof. Thus, it is an object of this invention to provide a bung plug assembly which combines bung plug and rope organizing functions, and which can be easily and quickly mounted on a clamshell canister.

SUMMARY

According to principles of this invention, a bung plug assembly comprises a resilient grommet cap holding a tubularly shaped housing to a canister with coiled rope therein paying out from a rope layer adjacent to an interior void of a coiled rope winding. There is a resilient rear cap at an opposite end of the tubularlyshaped housing through which an inner-end portion of the rope extends to a lanyard attached to a valve of a compressed-air cylinder. A bung plug through which the outer-end portion of the rope extends is insertable into a grommet-cap bore of the grommet cap and both the grommet cap and the rear cap have radially inwardly directed flanges which engage slots in an outer surface at opposite ends of the tubularly-shaped housing. A resilient molded key engages a key slot of the grommet cap for resiliently contacting the clamshell canister.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

FIG. 4 is a segmented side view of the bung plug assembly of FIG. 1;

FIG. 5 is a front end view of the bung plug assembly of FIG. 4, without a rope;

FIG. 6 is a rear end view of the bung plug assembly of FIG. 4 without a rope;

DESCRIPTION OF THE PREFERRED EMBODIMENT

Figure 1:
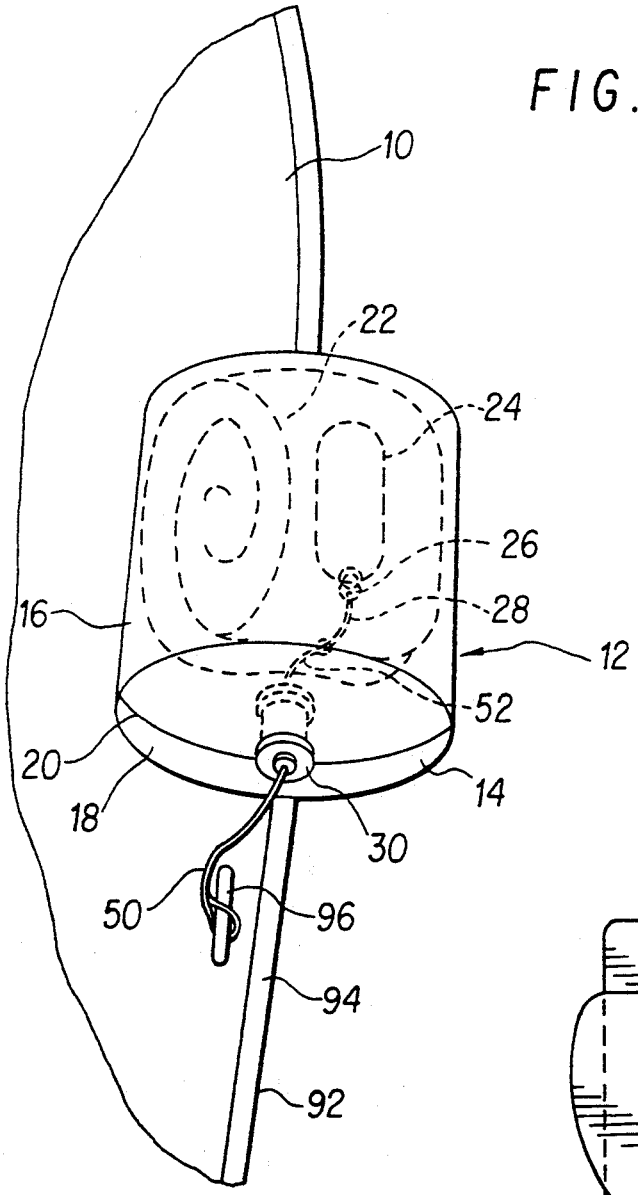
FIG. 1 is an isometric view of a section of a boat, or ship, having a clamshell canister with a bung plug assembly of this invention mounted thereon as well a life raft, and a compressed-air cylinder mounted in the canister.
Figure 7:
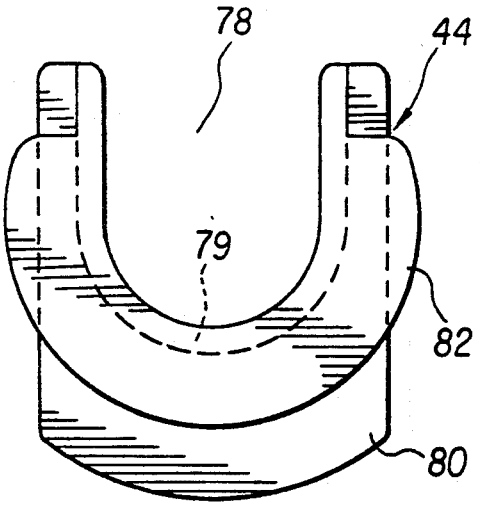
FIG. 7 is a front end view of a molded key of the bung plug assembly of the drawings.
Figure 8:
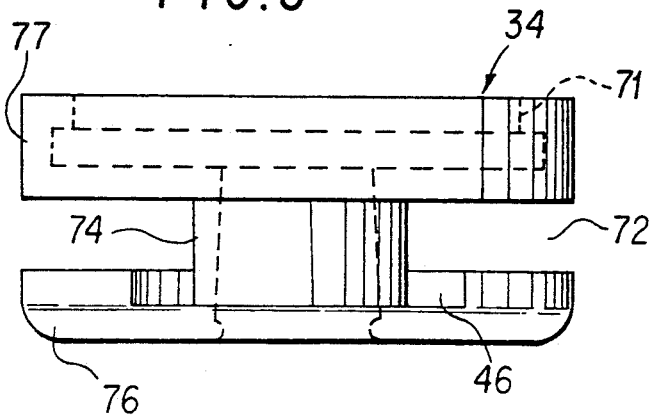
FIG. 8 is a side view of a grommet cap of the bung plug assembly of the other drawings.
Figure 2:
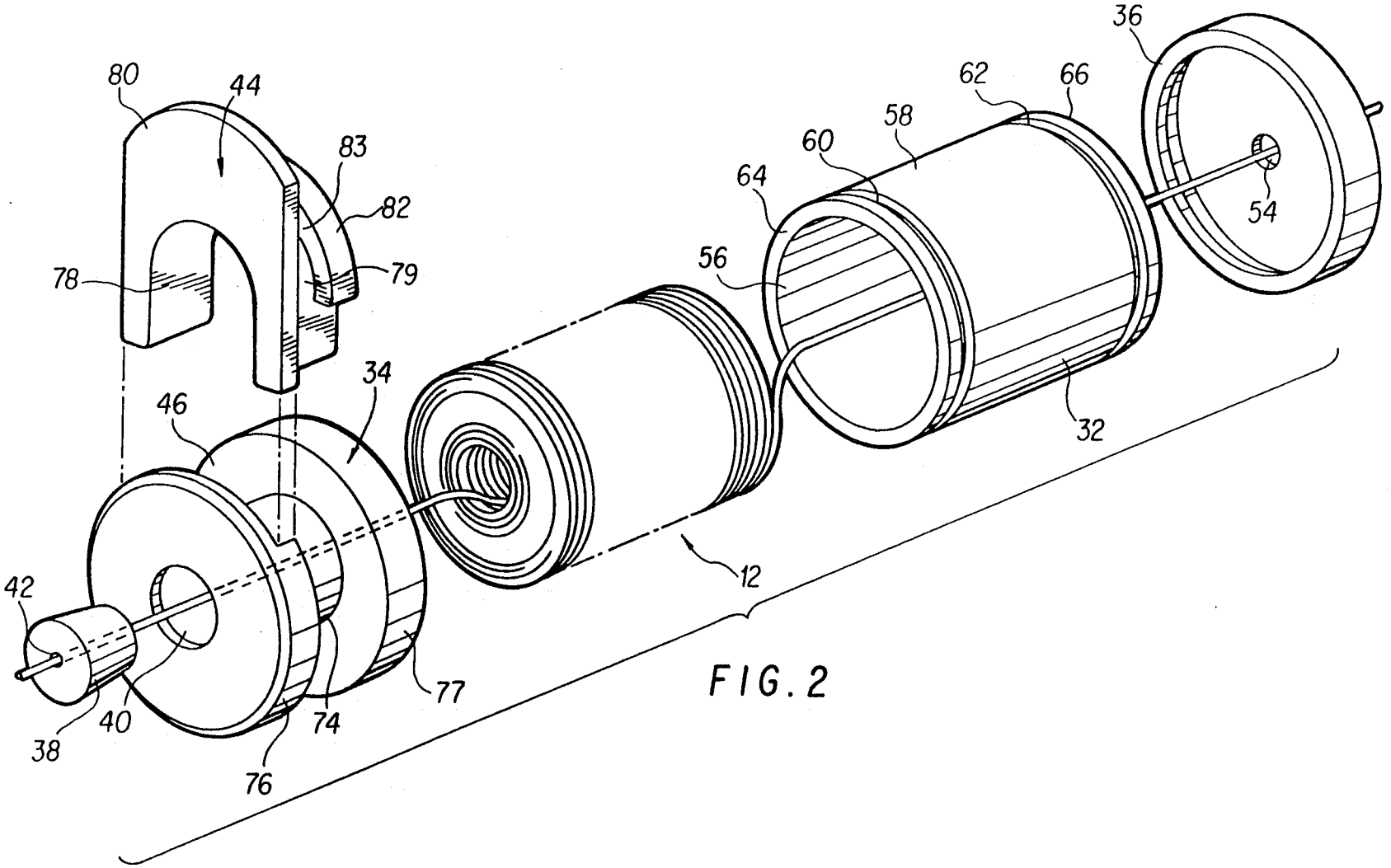
FIG. 2 is an exploded isometric view of the bung plug assembly of FIG. 1.

A boat, or ship, 10 has a life-raft assembly 12 mounted thereon including a clamshell canister 14 having a top half 16 and a bottom half 18 joined at an edge interface 20, an inflatable sixteen man life raft 22, a compressed-air cylinder 24 including a valve 26 and a lanyard 28, and a bung-plug assembly 30.

Looking now at the bung-plug assembly 30 of this invention in more detail, this device comprises a painter tube, or tubular housing 32; a grommet cap 34 mounted at a front, or an outwardly-directed, end of the tubular housing 32; a rear cap 36 mounted on an inwardly directed end of the tubular housing 32; a bung plug 38 tightly insertable into a grommet-cap bore 40 and having a rope passage 42 therethrough; a molded key 44 insertable into a key slot 46 of the grommet cap 34; and coiled rope in the form of a rope winding 48 having an outer-end portion 50 extending through the grommet-cap bore 40 of the grommet cap 34 and the rope passage 42 of the bung plug 38 and an inner-end portion 52 extending through an inside-cap bore 54.

The tubular housing 32 is constructed of hard PVC resinous plastic having a four inch length and a three inch internal diameter. An inner surface 56 thereof is completely smooth while an outer surface 58 has annular outwardly-directed, end 64 and a rear, or inwardly-directed, end 66.

The rear cap 36 is molded of a resilient, but medium-hard, rubber to have the inside-cap bore 54 therethrough and a radially-inwardly directed flange 68 thereon for mating with the annular slot 62 of the tubular housing 32 to hold the rear cap 36 on the tubular housing 32 covering its inwardly-directed end 66.

Figure 3:
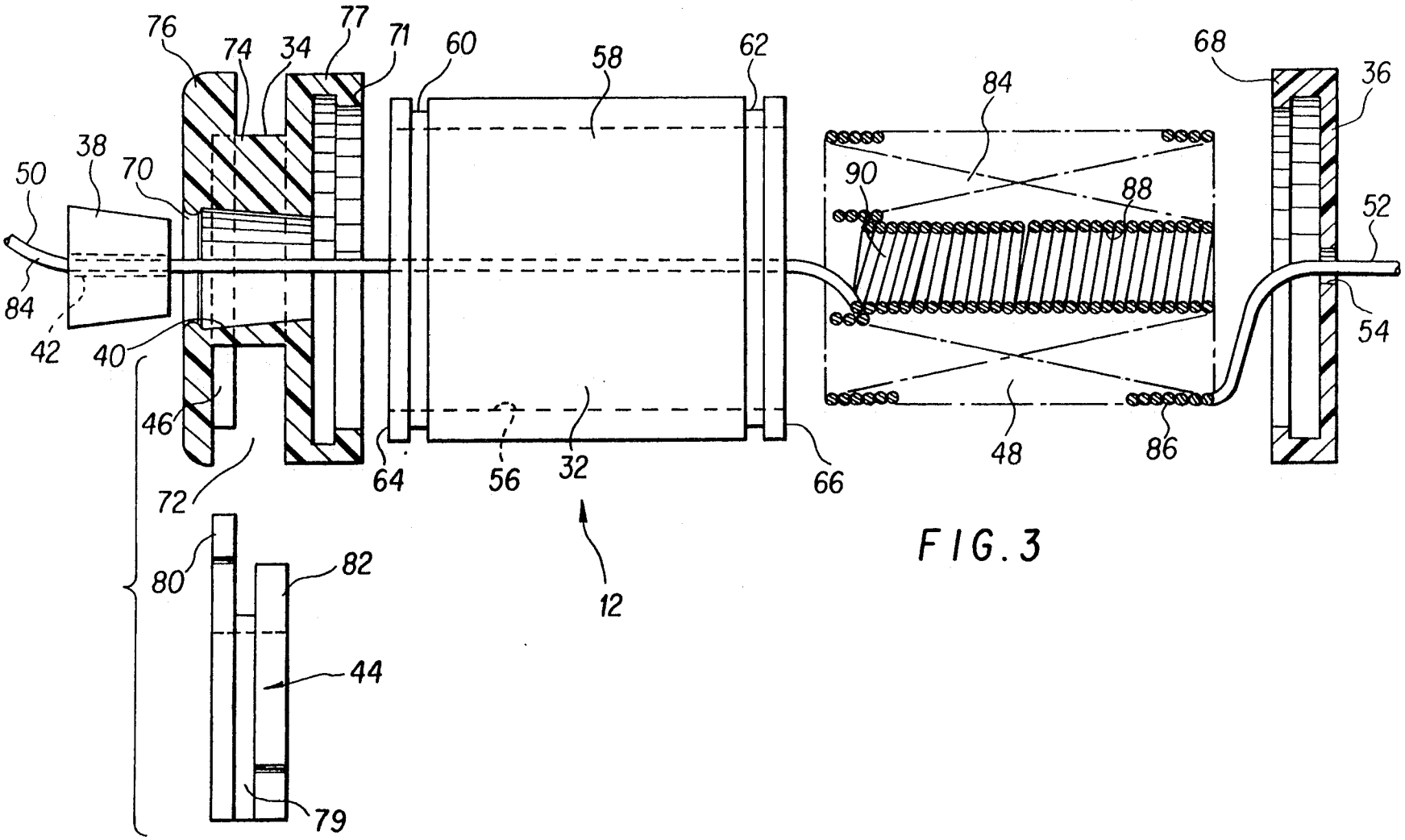
FIG. 3 is a segmented exploded side, partially cut away, or sectional, view of the bung plug assembly of FIG. 1.

The grommet cap 34 is also molded of a resilient, medium-hard, rubber to have the grommet-cap bore 40 therethrough for tightly receiving the bung plug 38. In this regard, it can be seen in FIG. 3 that the grommet-cap bore 40 is tapered inwardly toward the inside so that the further the bung plug 38 is shoved thereinto, the tighter a friction fit between it and a surface forming the grommet-cap bore 40 becomes. Further, the surface defining the grommet-cap bore 40 also includes a radially-inwardly directed lip 70 such that when the bung plug 38 is inserted into the grommet-cap bore 40 beyond the lip 70 the lip ensures that the bung plug 38 is not inadvertently pulled from the grommet cap 34. The grommet cap 34 also defines an radially-inwardly directed flange 71 for mating with the annular slot 60 in the tubular housing 32 to hold the grommet cap 34 covering the outwardly-directed end 64 of the tubular housing 32. Further, the grommet cap 34 is molded to define a radially-outwardly directed annular canister slot 72 for receiving edges of the bottom half 18 and the top half 16 of the clamshell canister 14. In this regard, the top and bottom halves of the clamshell canister 14 have semicircular shaped edges at the bung-plug assembly 30 for defining an opening into the canister for receiving a neck 74 of the grommet cap 34 through which the grommet-cap bore 40 extends. An outer rim, or flange, 76 of the grommet cap 34 defines the key slot 46 for receiving the molded key 44 and an inner rim 77 has the radially-inwardly directed flange 71 mounted thereon.

The molded key 44 is also molded of a semi-hard flexible rubber whose base wall 79 defines a U-shaped slot 78 for receiving the neck 74 of the grommet cap 34 and whose first and second outwardly-extending flanges 80 and 82 define a slot 83 for receiving the semicircular edges (not shown) of the top half 16 of the clamshell canister 14.

The bung plug 38 is also constructed of a rather hard flexible rubber with the rope passage 42 therethrough being small relative to a rope 84 forming the rope winding 48 so that when the outer-end portion 50 of the rope winding 48 is extended through the rope passage 42 of the bung plug 38, it is tightly held to the bung plug 38 by friction between the rope and a surface of the bung plug 38 forming the rope passage 42.

The rope winding 48 is formed by spirally winding the rope 84 to have an outer wound layer 86 and an inner wound layer 88. In this regard, the rope winding 48 is designated as coiled rope herein because the outer and inner-end portions 50 and 52, especially the inner-end portion 52, can be pulled from the rope winding 48 without tangling. It may be possible to use other configurations of coiled rope which can be "paid out" without tangling, however, it has been found that an inside pay out works quite well in this invention. It should be noted that the outer-end portion 50 of the rope winding 48 is taken from the inside layer 88 of the rope winding 48, which borders on a void 90 at a center of the rope winding 48. In one embodiment there are a plurality of such windings arranged end-to-end being interconnected to form the single rope winding 48.

Describing now operation of the life-raft assembly 12 utilizing the bung-plug assembly 30 of this invention, the life-raft assembly 12 is mounted near an edge 92 of the boat 10 where a handrail 94 is often located. The outer-end portion 50 of the rope winding 48, which extends through the grommet-cap bore 40 of the grommet cap 34 and through the rope passage 42 of the bung plug 38, is tied, or affixed, to a tie cleat 96, or the like, affixed to the ship 10. The bung plug 38 is fully inserted into the grommet-cap bore 40 of the grommet cap 34 so that the outer-end portion 50 cannot be inadvertently pulled further through the grommet cap 34. The top and bottom halves 16 and 18 of the clamshell canister 14 are mounted together at the edge interface 20 with semi-circular notches in the edge interfaces of the top and bottom halves extending about the neck 74 of the grommet cap 34 as well as about the base wall 79 of the molded key 44. The outer and inner rims 76 and 77 of the grommet cap 34 are respectively positioned outside and inside the clamshell canister 14 as are the outer and inner flanges 80 and 82 of the molded key 44. The inner-end portion 52 of the rope 84 forming the rope winding 48, after passing through the inside-cap bore 54 of the rear cap 36, is attached to the lanyard 28. The lanyard 28 is a chain, cable, or other strong tether attached to the valve 26 for controlling compressed air in the compressed-air cylinder 24. This valve 26, in turn, communicates with a nozzle of the life raft 22.

Upon an emergency, the clamshell canister 14, along with its contents and attachments, is dropped overboard, outside of the handrail 94. Weight of the canister 14 and its contents and attachments causes sufficient force pulling outwardly on the outer-end portion of the rope 84, relative to the clamshell canister 14, that the bung plug 38 is pulled from the grommet-cap bore 40 of the grommet cap 34. Thereafter, rope is pulled out, or paid out, through the grommet-cap bore 40 from inside layers 88 of the coiled-rope winding 48. Eventually, all 100 feet of rope 84 in the coiled-rope winding 48 has been paid out, at which point the rope 84 becomes taut between the tie cleat 96 and the lanyard 28. Thus, a pulling force is applied to the lanyard 28 which, in turn, applies a force to the valve 26, thereby opening the valve and inflating the life raft 22. Inflation of the life raft 22 pops attachment devices holding the top and bottom halves 16 and 18 of the clamshell canister 14 together so that these two halves separate, thereby freeing the life raft 22 to be ready for use in water.

Should a tangle develop in the rope 84 during its pay out, such a tangle can still pass through the grommet-cap bore 40 since the grommet cap 34 is quite flexible and, therefore, the grommet-cap bore 40 can expand to become larger and to accommodate such tangles and/or the entire grommet cap 34 can expand and contract to escape from the tubular housing 32 and the clamshell canister 14. Further, and similarly, should a tangle develop at the inner-end portion 52 of the rope, or should the lanyard be sufficiently long that it must pass through the cap bore 54 of the rear cap 36 in order to transmit force from the tie cleat 96 to the valve 26, such tangles and/or lanyard parts can easily pass through the inside-cap bore 54 because the rear cap 36 is also constructed of flexible rubber. Further, it is also possible for the flexible rear cap 36 to expand and/or contract to escape from the tubular housing 32 and pass through the tubular housing 32 and the clamshell canister 14 where necessary to accommodate a tangle between the bung-plug assembly 30 and the compressed air cylinder 24.

It will be appreciated by those of ordinary skill in the art that tangles are less likely to develop inside the tubular housing 32 because the inner surface 56 of the tubular housing 32 is smooth, with no discontinuities to promote such tangles.

Further, it will be appreciated by those of ordinary skill in the art that it is beneficial for the tubular housing 32 to be mounted onto the clamshell canister 14 by means of the grommet cap 34. This structure not only allows easy mounting of the bung-plug assembly 30, but also ensures that the tubular housing 32 remains close to, and aligned with, a pay out opening of the clamshell canister. Further, under normal circumstances the rubber grommet cap provides a soft guide for rope being paid out, so as not to cut or fray the rope, but yet can change shape to accommodate rope tangles under unusual circumstances.

The rear cap 36, also provides benefits in that it retains the coiled-rope winding 48 within the tubular housing 32 while not establishing an impediment to transmission of force along the inner-end portion 52 of the rope via the lanyard 28 to the valve 26 in the case of a tangle.

A benefit of having a separate molded key 44 with outer and inner flanges 80 and 82 is that this can be easily replaced when the clamshell canister 14 is opened for inspection without disassembling the entire bung-plug assembly 30. In this respect, the molded key 44, which is constructed of resilient rubber, resiliently holds the bung-plug assembly 30 to outer and inner surfaces of the clamshell canister 14 in a resilient manner. Should exterior portions of the molded key 44 and/or the grommet cap 34 become hard with age, a new molded key 44 can be inserted.

By stabilizing an aligned position of the tubular housing 32 within the clamshell canister 14 as described herein, it is easier to arrange other parts to provide for a smooth pay out of rope. In this respect, since the tubular housing 32 is attached to the clamshell canister by means of the resilient grommet cap 34 and the resilient molded key 44, it cannot unduly rotate or otherwise move to promote rope snags, but yet it can resiliently move to align it with the rope's inner end 52 when it becomes taut. In other words, it is held properly aligned.

Yet another benefit of this invention is that the rubber bung plug 38 mates with the rubber grommet cap 34. Such a rubber-on-rubber mating provides a much tighter mating than was accomplished in some prior-art devices so that there is less chance that the bung plug 38 will prematurely separate from the clamshell canister 14, thereby reducing the chance of premature pay out of rope. This maintains the integrity of the bung-plug assembly 30 for a controlled pay out only during times of emergency, which was not the case in many prior art systems.

By including the annular slots 60 and 62 in the outer surface of the tubular housing 32 which mate with the inwardly-directed flanges 68 and 71, no mechanical fasteners are required for attaching the grommet cap 34 and the rear cap 36 to the tubular housing 32. Also, such an attachment allows the inner surface of the tubular housing to be completely smooth for avoiding snags.

The rear cap 36 and the grommet cap 34 are used to close off, or seal, ends of the tubular housing in a manner for maintaining the coiled rope in an organized arrangement which does not promote snags in the rope 84.

Use of a rope winding with an inside pay out provides a clean pay out which is less likely to snag.

While the invention has been particularly shown and described with reference to a preferred embodiment, it will be understood by those skilled in the art that various changes in form and detail may be made therein without departing from the spirit and scope of the invention. For example, in one embodiment the rope winding is not a tight spiral winding.

The embodiments of the invention in which an exclusive property or privilege are claimed or defined are as follows:

1. A bung-plug assembly for allowing an outer-end portion of coiled rope to extend through a hole in a life raft canister while allowing pay out of said coiled rope through said hole when an outside end, which is outside said life raft canister, has a significant force applied thereto relative to said life raft canister and for supporting said coiled rope inside said life raft canister so as to allow said pay out upon application of said significant force, said bung-plug assembly comprising:

a tubularly-shaped housing for holding said coiled rope therein;

an engaging means at an outwardly directed end of said tubularly-shaped housing for engaging said canister at said hole and thereby at least partially supporting said bung-plug assembly from said canister.

2. A bung plug assembly as in claim 1 wherein said engaging means is a grommet cap having a grommet-cap bore therethrough through which said outside end portion of said rope extends, said grommet cap including a canister engaging means for engaging said canister.

3. A bung-plug assembly as in claim 2 wherein is further included a bung plug having a rope passage therethrough for tightly receiving said rope and for tightly engaging a surface of said grommet cap forming said grommet-cap bore.

4. A bung-plug assembly as in claim 3 wherein is further included a resilient rear cap for covering an inwardly directed end of said tubularly-shaped housing having an inside-cap bore therethrough for allowing passage of an inner-end portion of said rope.

5. A bung-plug assembly as in claim 4 wherein said tubularly-shaped housing has essentially a smooth interior surface but includes slots at opposite ends of an exterior surface, with said grommet cap and said rear cap including inwardly-directed flanges for engaging said slots for retaining said grommet cap and rear cap on said tubular housing.

6. A bung-plug assembly as in claim 5 wherein said coiled rope is wound into a rope winding with said outerend portion paying out from an interior of the winding.

7. A bung-plug assembly as in claim 6 wherein is further included a resilient key mounted in a slot of the grommet cap with a base separating outer and inner flanges thereof for receiving an edge of a half of said canister with the outer and inner flanges being respectively positioned outside and inside the canister.

8. A bung-plug assembly as in claim 2 wherein said grommet cap is constructed of a resilient material.

9. A bung-plug assembly as in claim 8 wherein is further included a resilient rear cap for covering an inwardly directed end of said tubularly-shaped housing having a inside-cap bore therethrough for allowing passage of an inner-end portion of said rope.

10. A bung-plug assembly as in claim 8 wherein is further included a resilient key mounted in a slot of the grommet cap with a base separating outer and inner flanges for receiving an edge of a half of said canister with the outer and inner flanges being respectively positioned outside and inside the canister.

11. A bung-plug assembly as in claim 2 wherein is further included a resilient key mounted in a slot of the grommet cap with a base separating outer and inner flanges for receiving an edge of a half of said canister with the outer and inner flanges being respectively positioned outside and inside the canister.

12. A bung-plug assembly as in claim 1 wherein is further included a resilient rear cap for covering an inwardly directed end of said tubularly-shaped housing having a inside-cap bore therethrough for allowing passage of an inner-end portion of said rope.

13. A bung-plug assembly as in claim 1 wherein said tubularly-shaped housing has essentially a smooth interior surface but includes slots at opposite ends of an exterior surface, with said grommet cap and said rear cap including inwardly-directed flanges for engaging said slots for retaining said grommet and rear caps on said tubular housing.

14. A bung-plug assembly as in claim 13 wherein said coiled rope is wound into a rope winding with said outer-end portion paying out from an interior of the winding.

15. A bung-plug assembly as in claim 1 wherein said coiled rope is wound into a rope winding with said outer-end portion paying out from an interior of the winding.

16. A bung-plug assembly for allowing an outer-end portion of coiled rope to extend through a hole in a life raft canister while allowing pay out of said coiled rope through said hole when an outside end, which is outside of said lift raft canister, has a significant force applied thereto relative to said canister and for supporting said coiled rope inside said lift raft canister so as to allow said pay out upon application of said significant force, said bung-plug assembly comprising:

a housing for enclosing said coiled rope therein;

an attachment means for attaching said housing to said canister at said hole.

17. A bung-plug assembly as in claim 16 wherein said coiled rope is wound into a rope winding having a void at a center portion thereof with said rope being paid out of layers of said rope winding at said void.

18. A bung-plug assembly as in claim 17 wherein said housing is tubularly shaped.

19. A bung-plug assembly as in claim 16 wherein is further included a resilient replaceable key mounted in said attachment means with a base separating outer and inner flanges for receiving an edge of said canister with the outer and inner flanges being respectively positioned outside and inside the canister.

20. A bung-plug assembly for allowing an outer-end portion of coiled rope to extend through a hole in a life raft canister while allowing pay out of said coiled rope through said hole when an outside end, which is outside of said life raft canister, has a significant force applied thereto relative to said canister and for supporting said coiled rope inside said life raft canister so as to allow said pay out upon application of said significant force, said bung-plug assembly comprising:

a tubularly-shaped housing for holding said coiled rope therein;

a resilient grommet cap attached to and covering one end of said tubularly-shaped housing and a resilient rear cap attached to and covering the other end of said tubularly-shaped housing.

21. A bung-plug assembly as in claim 20 wherein said coiled rope is formed in a rope bundle with rope from said rope bundle being paid out from an interior of said bundle.

22. A bung-plug assembly as in claim 20 wherein said tubularly-shaped housing has a smooth interior surface but slots at opposite ends thereof in an exterior surface for mating with inwardly-directed flanges of said grommet cap and said rear cap.

23. A bung-plug assembly for allowing an outer-end portion of coiled rope to extend through a hole in a life raft canister while allowing pay out of said coiled rope through said hole when an outside end, which is outside of said life raft canister, has a significant force applied thereto relative to said canister and for supporting said coiled rope inside said life raft canister so as to allow said pay out upon application of said significant force, said bung-plug assembly comprising:

a tubularly-shaped housing for holding said coiled rope therein;

wherein said coiled rope is formed in a rope bundle having a void therein with rope from said rope bundle being paid out from an interior of said bundle at said void.

* * * * *